US010002599B1

(12) United States Patent
Wolf

(10) Patent No.: US 10,002,599 B1
(45) Date of Patent: Jun. 19, 2018

(54) PICKUP ASSEMBLY FOR AN ELECTRICAL STRINGED MUSICAL INSTRUMENT

(71) Applicant: Rick Wolf, Kettering, OH (US)

(72) Inventor: Rick Wolf, Kettering, OH (US)

( * ) Notice: Subject to any disclaimer, the term of this patent is extended or adjusted under 35 U.S.C. 154(b) by 0 days. days.

(21) Appl. No.: 15/672,420

(22) Filed: Aug. 9, 2017

Related U.S. Application Data

(60) Provisional application No. 62/435,115, filed on Dec. 16, 2016.

(51) Int. Cl.
*G10H 3/14* (2006.01)
*G10H 3/18* (2006.01)

(52) U.S. Cl.
CPC ..... *G10H 3/181* (2013.01); *G10H 3/183* (2013.01); *G10H 2220/565* (2013.01)

(58) Field of Classification Search
CPC ... G10H 3/181; G10H 3/183; G10H 2220/565
USPC ..... 84/726–728
See application file for complete search history.

(56) References Cited

U.S. PATENT DOCUMENTS 2,145,490 A 1/1939 Miller
2,175,325 A 10/1939 Sunshine
4,133,243 A 1/1979 DiMarzio
4,220,069 A * 9/1980 Fender ..... G10H 3/182 84/726
4,320,681 A 3/1982 Altilio
4,425,831 A 1/1984 Lipman
4,433,603 A 2/1984 Siminoff
4,442,749 A 4/1984 DiMarzio et al.
4,854,210 A * 8/1989 Palazzolo ..... G10H 3/181 84/726
4,872,386 A 10/1989 Betticare
5,029,511 A 7/1991 Rosendahl
5,168,117 A 12/1992 Anderson
5,221,805 A 6/1993 Lace
5,252,777 A 10/1993 Allen
5,637,823 A 6/1997 Dodge
5,811,710 A 9/1998 Blucher et al.
5,894,101 A 4/1999 Damm
5,949,014 A 9/1999 Rashak et al.
6,103,966 A * 8/2000 Kinman ..... G10H 3/181 84/728
6,111,184 A 8/2000 Cloud et al.
6,253,654 B1 7/2001 Mercurio
6,291,759 B1 * 9/2001 Turner ..... G10H 3/181 336/110
6,372,976 B2 4/2002 Damm
8,178,774 B2 * 5/2012 Salehi ..... G10H 3/181 84/723

(Continued)

*Primary Examiner* — Jeffrey Donels
(74) *Attorney, Agent, or Firm* — Thomas E. Lees, LLC

(57) ABSTRACT

A pickup comprises a mounting component having a mounting plate, a first contact and a second contact. The pickup also has a coil component including a primary flatwork member, a secondary flatwork member, a pole therebetween, and a coil of wire wrapped around the pole. A magnet cooperates with the pole. A first coil end is electrically connected to a first coil component contact, and a second coil end is electrically connected to a second coil component contact. When assembled, the first coil component contact electrically couples to a select one of the first contact and the second contact of the mounting member regardless of the orientation of the coil component relative to the mounting plate.

20 Claims, 15 Drawing Sheets

(56) References Cited

U.S. PATENT DOCUMENTS

| | | | | |
|---|---|---|---|---|
| 8,415,551 | B1 | 4/2013 | Dixon | |
| 8,853,517 | B1 | 10/2014 | Dixon | |
| 8,907,199 | B1 | 12/2014 | Dixon | |
| 9,147,387 | B2 | 9/2015 | Wolf et al. | |
| 9,626,948 | B2 * | 4/2017 | Bath | G10H 3/183 |
| 9,773,488 | B2 * | 9/2017 | Wolf | G10H 3/183 |
| 2002/0083819 | A1 | 7/2002 | Kinman | |
| 2005/0162247 | A1 | 7/2005 | Beller | |
| 2006/0156911 | A1 | 7/2006 | Stich | |
| 2012/0103170 | A1 | 5/2012 | Kinman | |
| 2012/0210847 | A1 | 8/2012 | Adair et al. | |
| 2012/0210848 | A1 * | 8/2012 | Yamanaka | G10H 3/181 84/726 |
| 2013/0327202 | A1 | 12/2013 | Mills | |
| 2014/0245877 | A1 | 9/2014 | Gelvin | |
| 2015/0027300 | A1 * | 1/2015 | Wolf | G10H 3/181 84/726 |
| 2015/0053069 | A1 | 2/2015 | Heil et al. | |
| 2015/0199949 | A1 | 7/2015 | Fishman et al. | |
| 2016/0314775 | A1 * | 10/2016 | Wolf | G10H 3/183 |

* cited by examiner

A
1 MAGNET ON TOP

PICKUP ASSEMBLY FOR AN ELECTRICAL STRINGED MUSICAL INSTRUMENT

CROSS REFERENCE TO RELATED APPLICATIONS

This application claims the benefit of U.S. Provisional Patent Application Ser. No. 62/435,115, filed Dec. 16, 2016, entitled PICKUP ASSEMBLY FOR AN ELECTRICAL STRINGED MUSICAL INSTRUMENT, the disclosure of which is hereby incorporated herein by reference.

BACKGROUND

The present disclosure relates in general to a pickup for a stringed musical instrument, and more particularly to a pickup assembly for a stringed musical instrument that allows for the ready change and/or adjustment of the conventionally fixed electrical characteristics of the pickup.

A typical electric, stringed musical instrument such as an electric guitar or electric bass includes body, a neck extending from the body, and a headstock situated at the end of the neck. A set of strings span between a bridge located on the body and a nut located on the neck adjacent to the headstock. When strummed, plucked, picked or otherwise stroked, the strings vibrate producing sound. However, the acoustical output of the vibrating strings may not be loud enough for an intended application. As such, the instrument typically includes one or more electromagnetic pickups. The pickups convert the vibration of the strings into a representative electrical signal that can be coupled to an amplifier to produce an appropriate level of sound from the instrument.

BRIEF SUMMARY

According to aspects of the present disclosure, a pickup for a stringed musical instrument is provided. The pickup comprises a mounting component and a coil component. The mounting component comprises a mounting plate having a first contact and a second contact. Here, the first contact and the second contact are provided for connection to electronics of a musical instrument to which the pickup is installed, e.g., via hookup wires. The coil component comprises a primary flatwork member, a secondary flatwork member, a pole that mounts between the primary flatwork member and the secondary flatwork member, and a coil of wire wrapped around the pole. The coil of wire has a first coil end electrically connected to a first coil component contact, and a second coil end electrically connected to a second coil component contact. As such, when the pickup is assembled, the coil component is user oriented with a select one of the primary flatwork member and the secondary flatwork member towards the mounting plate. Also, the coil component is user removable from, and mechanically couplable to the mounting component. When assembled, the first coil component contact electrically couples to a select one of the first contact and the second contact of the mounting member regardless of the orientation of the coil component, and the second coil component contact electrically couples to the remaining one of the first contact and the second contact of the mounting member regardless of the orientation of the coil component.

The pickup further comprises at least one of a magnet positioned over the coil component opposite the mounting component, a magnet positioned between coil component and the mounting component, and a magnet integrated with the pole.

According to further aspects of the present disclosure, a pickup for an electric, stringed musical instrument is provided. The pickup comprises a mounting component, a coil component, and a magnetics component. The mounting component comprises a mounting plate having a first contact and a second contact, where the first contact and the second contact are provided for connection to electronics of a musical instrument to which the pickup is installed, e.g., via hookup wires. The coil component comprises a primary flatwork member having a first contact and a second contact, a secondary flatwork member having a third contact and a fourth contact, a pole piece that mounts between the primary flatwork member and the secondary flatwork member. A coil of wire is wrapped around the pole piece. The coil of wire has a first coil end electrically connected to the first contact on the primary flatwork member and the third contact on the secondary contact member. Likewise, a second coil end is electrically connected to the second contact on the primary flatwork member and the fourth contact on the secondary contact member. The magnetics component comprises a magnet housing, and a magnet supported by the magnet housing. When the pickup is assembled, the coil component and the magnetics component are user removable from, and mechanically couplable to the mounting component. Also, the mounting component, the coil component, and the magnetics component are assembled together such that the magnet of the magnetics component is in magnetic cooperation with the pole piece. Further, a select one of the primary flatwork and the secondary flatwork is oriented towards the mounting plate. Here, the first coil end electrically couples to a select one of the first contact and the second contact of the mounting member, and the second coil end electrically couples to the remaining one of the first contact and the second contact of the mounting member.

According to yet further aspects of the present disclosure, a pickup for a stringed musical instrument is provided. The pickup comprises a mounting component, and a coil component. The mounting component comprises a mounting plate having a first contact and a second contact. The first contact and the second contact are provided for connection to electronics of a musical instrument to which the pickup is installed. The coil component comprises a primary flatwork member having a first contact and a second contact, a secondary flatwork member having a first contact and a second contact, a pole piece that mounts between the primary flatwork member and the secondary flatwork member, and a coil of wire wrapped around the pole piece. The coil of wire has a first coil end electrically connected to the first contact of the primary flatwork member and the first contact of the secondary contact member, and a second coil end electrically connected to the second contact of the primary flatwork member and the second contact of the secondary contact member. The pickup further comprises a magnet in magnetic cooperation with the pole piece of the coil component. Wherein when the pickup is assembled, a select one of the primary flatwork and the secondary flatwork is oriented towards the mounting plate. Also, the coil component is user removable from, and mechanically couplable to the mounting component. Yet further, the first coil end electrically couples to a select one of the first contact and the second contact of the mounting member. Likewise, the second coil end electrically couples to the remaining one of the first contact and the second contact of the mounting member.

BRIEF DESCRIPTION OF THE SEVERAL VIEWS OF THE DRAWINGS

Reference is made to the FIGURES, where like reference numbers correspond to like elements throughout.

DETAILED DESCRIPTION

Figure 1:
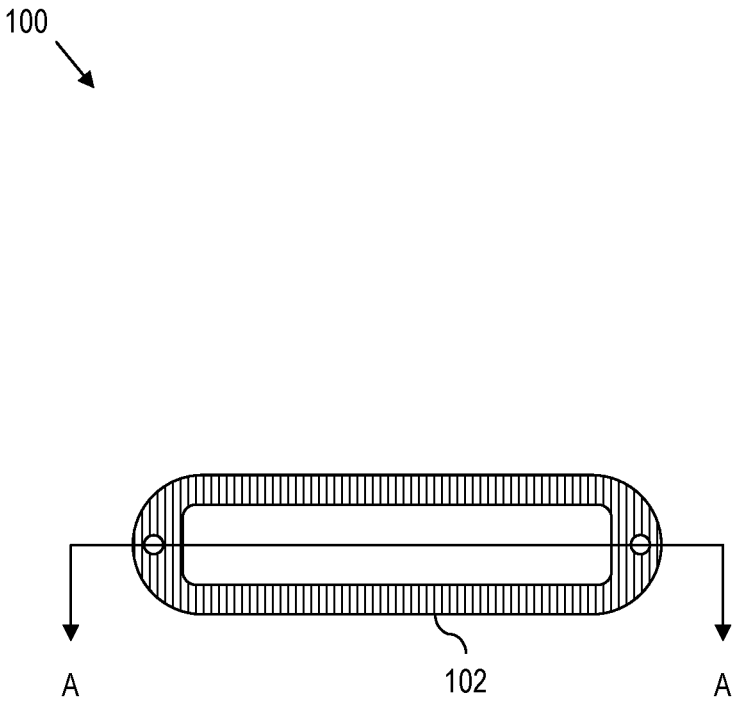
FIG. 1 is a top view of a pickup of the present disclosure in a single coil form, according to aspects of the present disclosure.

According to various aspects of the present disclosure, a pickup for an electric, stringed musical instrument includes a mounting component that attaches to the wiring of a corresponding stringed musical instrument. The pickup also includes a user-changeable magnet assembly, a user-changeable coil assembly, or both. Notably, the user-changeable magnet assembly and/or the user-changeable coil assembly can be modified or swapped out of the pickup without unwiring the corresponding mounting component to corresponding instrument electronics. According to aspects of the present disclosure, the pickup thus comprises a mounting component and a coil component that is separable from the mounting component. Likewise, the pickup can include a magnet assembly that is separable from the mounting component.

In certain embodiments, the user-changeable magnet assembly and the user-changeable coil assembly can be swapped out, re-oriented, adjusted, modified, etc., using conventional tools, e.g., a screwdriver, without disassembling the associated instrument, except maybe to loosen strings of the instrument.

The user-changeable magnet assembly and the user-changeable coil assembly facilitate changing the properties of the pickup, thus modifying the output of the stringed musical instrument to which the pickup is installed, without disturbing the electrical wiring of the pickup to other electronics in a corresponding instrument. For instance, the properties of the pickup installed in an instrument can be altered by exchanging a first changeable magnet assembly with a second changeable magnet assembly, where the second changeable magnet assembly includes a magnet or magnets having different properties compared to the magnet/magnets of the first changeable magnet assembly. Also, in some embodiments, the position of the magnets within the pickup can be changed, e.g., moved from on top of the pole piece to underneath the pole piece, etc. Changing the magnetic properties can result in moderate to significant changes to the response, output, harmonics and sound of the pickup in an instrument.

Likewise, in some embodiments, the properties of the pickup installed in an instrument can be altered by reorienting an existing coil assembly, and/or by exchanging a first changeable coil assembly with a second changeable coil assembly, where the second changeable coil assembly includes a coil (e.g., wire diameter, wire material, insulator, number of windings, winding pattern, etc.) having different properties compared to the coil of the first changeable coil assembly. Changing the coil assembly can also have moderate to drastic changes to the response, output, harmonics and sound of the pickup in an instrument.

According to further aspects of the present disclosure, in some embodiments, a pickup for an electrical, stringed musical instrument is provided, which allows user adjustment of the magnet position within the pickup relative to a pole of the pickup. The ability to adjust the magnet position relative to the pole position allows a user to make "on-the-fly" adjustments to the performance of the pickup. As such, pickups are provided herein, that allow for the convenient and ready change and/or adjustment of the electrical characteristics of the pickup by providing for the changeover and/or adjustment of the relationship between a pole and a magnet of the pickup, as will be described in greater detail herein.

Still further, the nature of the construction of the disclosed pickups facilitates fast and efficient construction and assembly, making the pickups herein suitable for large volume production.

Example Pickup Construction—Single Coil

Referring now to the drawings and in particular to FIG. 1, a top view 100 illustrates a pickup 102 for an electrical, stringed musical instrument, according to certain aspects of the present disclosure. The pickup 102 is an electromagnetic device and has a cross-section along line A-A, which is provided to clarify the construction thereof, as described more fully herein. In the example of FIG. 1, the pickup 102 is shown as a single coil pickup for sake of clarity of discussion. However, the concepts disclosed herein, can be utilized to build humbucker and other pickup configurations in addition to single coil configurations.

Figure 2:
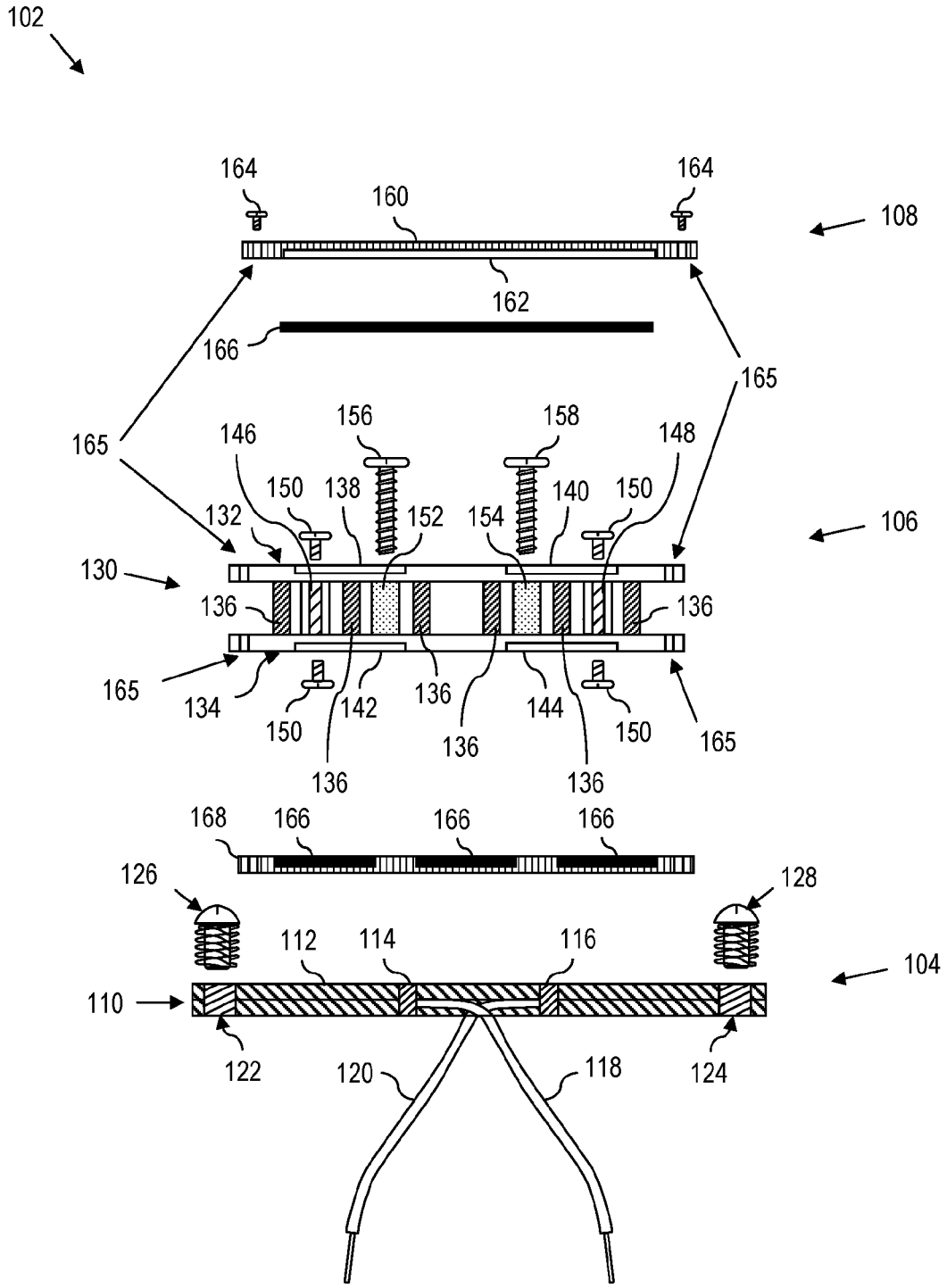
FIG. 2 is an exploded assembly view of select components of the pickup of FIG. 1 along cross-section line A-A.

Referring to FIG. 2, an exploded side view of the pickup 102 of FIG. 1 is illustrated with some parts (e.g., wire) removed for clarity of discussion. The view of FIG. 2 is taken along line A-A of FIG. 1.

The illustrated embodiment of the pickup 102 includes in general, three assemblies, including a mounting assembly 104, a coil assembly 106, and a cover assembly 108.

Mounting Assembly

The mounting assembly 104 includes in general, a mounting component 110 that comprises a mounting plate 112 having a first contact 114 and a second contact 116. In an example implementation, the first contact 114 comprises a conductive threaded insert that extends into the mounting plate 112. As illustrated, a first conductive wire 118 is electrically connected to the first contact 114. Analogously, in this example implementation, the second contact 116 comprises a conductive threaded insert that extends into the mounting plate 112. As illustrated, a second conductive wire 120 is electrically connected to the second contact 116.

In general, for a single coil pickup 102, one conductive wire will carry the signal sensed by the pickup, and the other conductive wire will typically connect to ground. However, the precise connection of the pickup 102 to the electronics of the corresponding stringed musical instrument will depend upon the desired electrical configuration, and will not be discussed in greater detail herein. However, for sake of being thorough, the second conductive wire 120 can alternatively electrically couple to the first contact 114, and the first conductive wire 118 can electrically couple to the second contact 116.

In practical implementations, the mounting component 110 can be implemented by two or more layers joined together. The ability to sandwich two or more layers enables convenient assembly, e.g., by facilitating convenience to solder, crimp, mechanically join or otherwise electrically connect the first conductive wire 118 to the first contact 114, and to solder, crimp, mechanically join or otherwise electrically connect the second conductive wire 120 to the second contact 116. By sandwiching the first conductive wire 118 and the second conductive wire 120 between layers of the mounting component 110, strain relief is provided, making strong, reliable electrical connections, improving reliability of the pickup 102 when installing the pickup 102 in a stringed musical instrument. In alternative implementations, the first conductive wire 118 and the second conductive wire 120 can be mounted to the top side or bottom side of the mounting component 110, using holes or other features for strain relief.

In practical implementations, the mounting component 110 also includes a first mounting aperture 122 towards a first end thereof, and a second mounting aperture 124 towards a second end opposite the first end thereof. The first mounting aperture receives a first height adjustment member 126, e.g., a screw, bolt, stud, etc. Likewise, the second mounting aperture 124 receives a second height adjustment member 128, e.g., a screw, bolt, stud, etc. The first height adjustment member 126 and the second height adjustment member 128 can each include a spring or other feature for mounting to a pickguard of a corresponding musical instrument to install the mounting component 110 to a corresponding stringed musical instrument. In alternative implementations, the first height adjustment member 126 and the second height adjustment member 128 can attach directly to a body of the stringed musical instrument, e.g., screw, bolt, clip, fasten, mechanically bond or otherwise secure into the body. In this example, the spring, where used, can be moved to a position underneath the mounting component 110.

The first contact 114 and the second contact 116, e.g., via respective conductive wires 118 and 120, provide an electrical connection to electronics of the musical instrument to which the pickup 102 is installed, e.g., to a pickup selector switch, to a potentiometer, to active electronics, or other instrument circuitry.

Coil Assembly

The coil assembly 106 includes a coil component 130 comprising a primary flatwork member 132, a secondary flatwork member 134, and a pole 136 that mounts between the primary flatwork member 132 and the secondary flatwork member 134. The primary flatwork member 132 and the secondary flatwork member 134 can be nonconductive material, e.g., plastic, butyrate, a semi-rigid fibrous material, etc.

As used herein, the term "pole" 136 encompasses a single element, a combination of elements, an assembly of elements(s) and other structure(s), etc. As a few non-limiting but illustrative examples, the pole 136 may be constructed from a ferrous material (e.g., iron or steel being the most common), a ferromagnetic material, a magnetic material, an otherwise magnetizable material, or any other suitable material that contributes to the ability of the pickup to create a magnetic field or otherwise sense a change in the magnetic field. Moreover, the pole 136 can be constructed in any suitable configuration. For instance, the pole 136 may be a blade, a set of individual slugs, a set of individual threaded pole pieces, any combination of blades, slugs and screws, bolts, etc. As used herein, the term "slug" with regard to the pole 136 includes a generally cylindrical shape, a cube or cuboid shape, a spherical shape, an irregular shape or other desired configuration that can cooperate with one or more magnets to create a magnetic field about the pickup 102.

As a few illustrative examples, the pole 136 may comprise at least one blade (e.g., a generally cuboid shaped bar that is dimensioned to span all strings of a corresponding instrument to which the corresponding pickup is intended). The pole 136 may also be implemented as a set of slugs (e.g., one or more slugs dimensioned and spaced to generally align under each string of a corresponding instrument). Still further, the pole 136 may be implemented as a set of slugs where one slug is dimensioned and spaced to generally align under two or more strings of a corresponding instrument. The above-examples are non-limiting and other elements and configurations can be used as the pole 136.

Solely for sake of clarity of illustration, in the example implementation, the pole 136 is implemented as six individual slugs standing between the primary flatwork member 132 and the secondary flatwork member 134.

In an example configuration, the coil assembly 106 also includes a first coil component contact 138, a second coil component contact 140, a third coil component contact 142, and a fourth coil component contact 144. As illustrated, the first coil component contact 138 and the second coil component contact 140 are provided on the primary flatwork member 132. Correspondingly, the third coil component contact 142 and the fourth coil component contact 144 are provided on the secondary flatwork member 134. Stated another way, the first coil component contact 138 and the second coil component contact 140 define first and second contacts of the primary flatwork member 132. Analogously, the third coil component contact 142 and the fourth coil component contact 144 define first and second contacts of the secondary flatwork member 134.

A first conductive bridge 146 electrically connects the first coil component contact 138 to the third coil component contact 142. For instance, a first pair of conductive fasteners 150 (e.g., screw, bolt, stud, etc.) ensure a reliable electrical connection between the first coil component contact 138 and the third coil component contact 142 via the first conductive bridge 146. Analogously, a second conductive bridge 148 electrically connects the second coil component contact 140 to the fourth coil component contact 144. For instance, a second pair of conductive fasteners 150 ensure a reliable electrical connection between the second coil component contact 140 and the fourth coil component contact 144 via the second conductive bridge 148.

In the example configuration, the coil assembly 106 also includes a first guide component 152 and a second guide component 154. The first guide component 152 is positioned so as to align a through hole of the coil component 130 with the first contact 114 of the mounting component 110. Likewise, the second guide component 154 is positioned so as to align a through hole of the coil component 130 with the second contact 116 of the mounting component 110. Here, the first guide component 152 and the second guide component 154 may each comprise a non-conductive, e.g., nylon, plastic, etc., sleeve or bushing that serves as a passageway through the coil component 130. In this regard, the first guide component 152 and the second guide component 154 do not require internal threads, although internal threads could be used if required by a particular implementation.

As will be described in greater detail herein, a coil of wire (not shown for clarity) is wrapped around the pole 136. Moreover, a first coil end is electrically connected (e.g., soldered) to the first coil component contact 138, and a second coil end is electrically connected (e.g., soldered) to the second coil component contact 140.

To mate the coil assembly 106 to the mounting assembly 104, a first conductive fastener 156 is passed through the first guide component 152 and threads into the first contact 114 of the mounting component 110. Likewise, a second conductive fastener 158 is passed through the second guide component 154 and threads into the second contact 116 of the mounting component 110.

In this manner, the first conductive fastener 156 mechanically couples the coil assembly 106 to the mounting assembly 104. Also, the first conductive fastener 156 electrically couples the first coil component contact 138 (and hence, a first coil end of the coil) to the first contact 114 (and hence the first conductive wire 118 of the mounting component 110). Likewise, the second conductive fastener 158 mechanically couples the coil assembly 106 to the mounting assembly 104. Also, the second conductive fastener 158 electrically couples the second coil component contact 140 (and hence, a second coil end of the coil) to the second contact 116 (and hence the second conductive wire 120 of the mounting component 110).

Cover Assembly

The optional cover assembly 108 comprises a cover plate 160. The cover plate hides the wiring, and can be used for aesthetic purposes, e.g., to provide customized engraving or other marking, to mimic the look of traditional pickups, etc. In certain example embodiments, an optional well 162 can be provided on the underside of the cover plate 160, e.g., for holding one or more magnets as will be described in greater detail below. In this regard, the cover plate 160 also functions as a magnet plate.

Also, optionally, the cover plate 160 can include apertures that align with corresponding apertures in the coil assembly 106 to allow fasteners 164 to temporarily secure the cover plate 160 to the coil assembly 106.

In practical implementations, the primary flatwork member 132 and the secondary flatwork member 134 each have apertures 165 that align with the corresponding apertures 165 in the cover plate 160. This allows the cover assembly 108 to secure to the coil assembly 106 regardless of the orientation of the coil component 130 as will be described in greater detail herein.

Magnets

The pickup includes one or more magnets 166. As used herein, the term "magnet" 166 can in practice, be a single magnet, a combination of individual magnets, an assembly of magnet(s) and non-magnetic structure(s), etc. As a few non-limiting but illustrative examples, the magnet 166 may comprise a single magnet, e.g., a permanent magnet such as a ceramic magnet, a magnet of Alnico 2, a magnet of Alnico 5, a neodymium magnet, a magnet of samarium cobalt, or other material types.

As a further example, the magnet 166 may be implemented as a set (e.g., one or more) of magnetic slug(s) where the slugs can be the same or different magnet type. As used herein, the term "slug" with regard to the magnet 166 includes a generally cylindrical shape, a cube or cuboid shape, a spherical shape, an irregular shape or other desired configuration that allows one or more magnets to be placed in the magnet well or otherwise arranged such that the magnet well 162 holds the magnet 166. For instance, if the pole 136 is individual steel slugs, the magnet 166 can be a set of magnetic slugs, where one or more magnetic slugs align with each pole slug. Alternatively, one magnetic slug can align with one or more pole slugs, one pole slug can align with one or more magnet slugs, etc. As yet a further example, the magnet 166 can include an assembly such as two individual magnets that sandwich a steel bar, a combination of one or more magnet(s) and one or more structure(s), etc. In this regard, a magnet assembly can include non-magnetic structures, e.g., housing, spacers, shims, etc.

As will be described in greater detail herein, the magnet(s) 166 can be placed above the coil component 130, e.g., as illustrated for example as a bar magnet or other magnet shape(s) and/or type(s) seated in the well 162 of the cover plate 160.

A magnet can be positioned below the coil component 130, e.g., as illustrated by the optional magnets 166 seated in an optional magnet housing 168 (shown as multiple individual magnets for example purposes).

Yet further, the pole 136 of the coil assembly 106 can itself be magnetized.

Moreover, in example configurations, one or more magnets 166 can be positioned in any one or more locations, e.g., above the coil component 130, below the coil component 130, as a magnetized pole (or magnetized pole pieces), or any combination thereof.

Coil Assembly Orientations

The coil assembly 106 secures to, and electrically connects a coil of wire (see FIG. 6) to the mounting assembly 104 via the first conductive fastener 156 and the second conductive fastener 158. In this regard, the coil assembly 106 can be removed from the mounting component 110 and can be reoriented in a number of configurations, e.g., simply by removal of the first conductive fastener 156 and the second conductive fastener 158 in the illustrated example.

For instance, in the example configuration of FIG. 2, the coil component 130 is user oriented with a select one of the primary flatwork member 132 and the secondary flatwork member 134 towards the mounting component 110. Moreover, as noted above, the coil component 130 is user removable and mechanically coupled to the mounting component 110 via the first conductive fastener 156 and the second conductive fastener 158. In this regard, the first coil component contact 138 electrically couples to a select one of the first contact 114 and the second contact 116 of the mounting component 110 regardless of the orientation of the coil component 130. Also, the second coil component contact 140 electrically couples to the remaining one of the first contact 114 and the second contact 116 of the mounting component 110 regardless of the orientation of the coil component 130.

More particularly, the coil component 130 can assume a first orientation. Here, the secondary flatwork member 134 is towards the mounting plate 112 of the mounting component 110. The first guide component 152 is aligned with the first contact 114 of the mounting component 110, and the second guide component 154 is aligned with the second contact 116 of the mounting component 110. The first conductive fastener 156 electrically connects the first coil component contact 138 (and hence, to the first coil end of the coil wrapped around the pole 136) to the first contact 114 of the mounting component 110. Likewise, the second conductive fastener 158 electrically connects the second coil component contact 140 (and hence, to the second coil end of the coil wrapped around the pole 136) to the second contact 116 of the mounting component 110.

The coil component 130 can assume a second orientation. The second orientation is achieved by rotating the coil component 180 degrees in the horizontal plane relative to FIG. 2. Here, the secondary flatwork member 134 is again towards the mounting plate 112 of the mounting component 110. However, the first conductive fastener 156 electrically connects the first coil component contact 138 (and hence, to the first coil end of the coil wrapped around the pole 136) to the second contact 116 of the mounting component 110. As such, the second conductive fastener 158 electrically connects the second coil component contact 140 (and hence, to the second coil end of the coil wrapped around the pole 136) to the first contact 114 of the mounting component 110. Thus, the coil is 180 degrees out of phase compared to the first orientation. Other electrical characteristics of the pickup 102 can also change in the second orientation relative to the first orientation due to magnet repositioning and winding pattern change as will be described in greater detail herein.

The coil component 130 can also assume a third orientation. The third orientation is achieved by rotating the coil component 180 degrees in the vertical plane as relative to FIG. 2. Here, the primary flatwork member 132 is towards the mounting plate 112 of the mounting component 110. The first guide component 152 is aligned with the first contact 114 of the mounting component 110, and the second guide component 154 is aligned with the second contact 116 of the mounting component 110. Here, the first conductive fastener 156 electrically connects the third coil component contact 142 to the first contact 114 of the mounting component 110. However, the third coil component contact 142 is also electrically connected to the first coil component contact 138 via the first conductive bridge 146 (and hence, to the first coil end of the coil wrapped around the pole 136). Likewise, the second conductive fastener 158 electrically connects the fourth coil component contact 144 to the second contact 116 of the mounting component 110. However, the fourth coil component contact 144 is also electrically connected to the second coil component contact 140 via the second conductive bridge 148 (and hence, to the second coil end of the coil wrapped around the pole 136).

The coil component 130 can yet further assume a fourth orientation. The fourth orientation is 180 degrees rotation of the coil component 130 relative to the third orientation. Here, the primary flatwork member 132 is again towards the mounting plate 112 of the mounting component 110. However, the first guide component 152 of the coil assembly 106 aligns with the second contact 116 of the mounting component 110, and the second guide component 154 of the coil assembly 106 aligns with the first contact 114 of the mounting component 110. Here, the first conductive fastener 156 electrically connects the third coil component contact 142 to the second contact 116 of the mounting component 110. However, the third coil component contact 142 is also electrically connected to the first coil component contact 138 via the first conductive bridge 146 (and hence, to the first coil end of the coil). Likewise, the second conductive fastener 158 electrically connects the fourth coil component contact 144 to the first contact 114 of the mounting component 110. However, the fourth coil component contact 144 is also electrically connected to the second coil component contact 140 via the second conductive bridge 148 (and hence, to the second coil end of the coil wrapped around the pole 136).

As noted above, regardless of which orientation of the coil assembly 106, the magnet(s) can be positioned above the coil component 130, below the coil component 130, integrated with the coil assembly 106 (e.g., via magnetized pole or pole pieces 136) or a combination thereof.

Example Flatwork Construction

Figure 3:
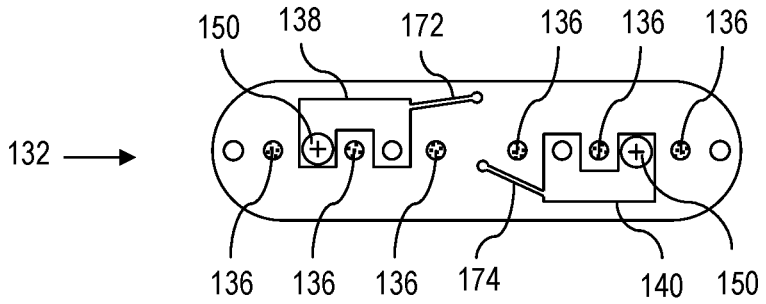
FIG. 3 is a top view of a coil component of FIG. 2, according to aspects of the present disclosure.

Referring to FIG. 3, a top view of the primary flatwork member 132 is illustrated according to aspects of the present disclosure. As illustrated, the poles 136 are visible but need not be. In the example configuration, the first coil component contact 138 is illustrated as a generally U-shaped conductive pad. An optional channel 172 can be provided to bring the first coil end of the coil to the top of the primary flatwork member 132 for soldering to the first coil component contact 138. Analogously, the second coil component contact 140 is illustrated as a generally U-shaped conductive pad. An optional channel 174 can be provided to bring the second coil end to the top of the primary flatwork member 132 for soldering to the second coil component contact 140. Although not expressly required, the first coil component contact 138 is seated in a well that is recessed into the primary flatwork member 132, and the second coil component contact 140 is seated in a well that is recessed into the primary flatwork member 132. This allows the primary flatwork member 132 to rest flush with the cover plate 160 or mounting plate 112 (depending upon orientation) despite the first coil component contact 138, the second coil component contact 140, conductive fasteners 150, solder connections and other artefacts of construction. Moreover, in some example implementations, the conductive pads can be implemented using conductive foil, a printed circuit board or other conductive material.

Figure 4:
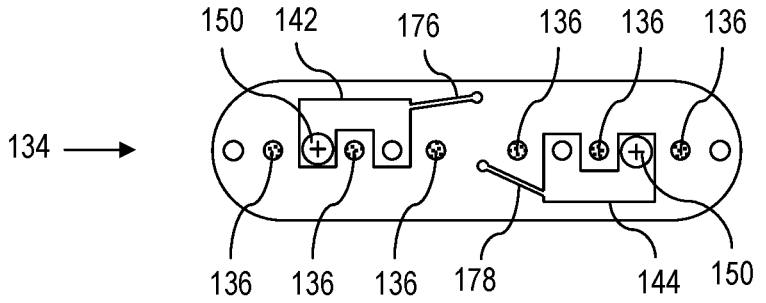
FIG. 4 is a bottom view of the coil component of FIG. 3, according to aspects of the present disclosure.

Referring to FIG. 4, a top view of the secondary flatwork member 134 is illustrated according to aspects of the present disclosure. As illustrated, the poles 136 are visible but need not be. As illustrated, the third coil component contact 142 is illustrated as a generally U-shaped conductive pad. An optional channel 176 can be provided in case the builder wishes to solder the first coil end to the top of the secondary flatwork member 134 instead of the primary flatwork member 132. Analogously, the fourth coil component contact 144 is illustrated as a generally U-shaped conductive pad. An optional channel 178 can be provided in case the builder wishes to solder the second coil end to the top of the secondary flatwork member 144 instead of the primary flatwork member 132. Although not expressly required, the third coil component contact 142 is seated in a well that is recessed into the secondary flatwork member 134, and the fourth coil component contact 144 is seated in a well that is recessed into the secondary flatwork member 134. This allows the secondary flatwork member 134 to rest flush with the cover plate 160 or mounting plate 112 (depending upon orientation) despite the third coil component contact 142, the fourth coil component contact 144, conductive fasteners 150 and solder connections.

In the preceding FIGURES, the coil component 130 could be formed by the primary flatwork member 132 and the secondary flatwork member 134 spaced apart by the slugs 136. In this example configuration, the primary flatwork member 132 and the secondary flatwork member 134 are non-conductive. However, other constructions can be implemented.

Figure 5:
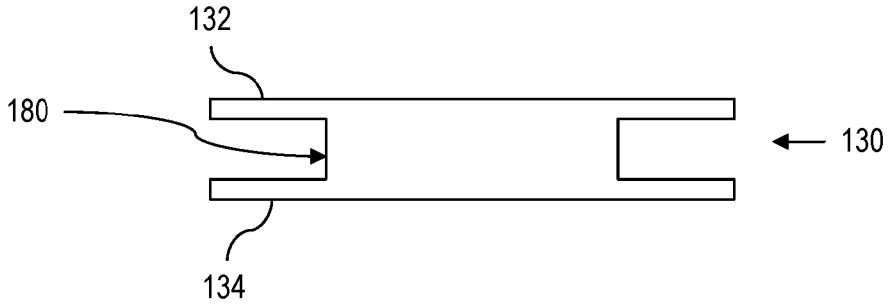
FIG. 5 is a side view of an exemplary bobbin that can be used as in a coil assembly of a pickup according to aspects of the present disclosure.

Referring to FIG. 5, the coil component 130 can be implemented by a non-conductive bobbin construction 180 that defines the primary flatwork member 132 and the secondary flatwork member 134. Many single coil designs do not use a bobbin. Comparatively, if the pickup 102 is being constructed as a "P-90" style or traditional "humbucker" style, then a bobbin is typically used, but is not required.

Winding Examples

Figure 6:
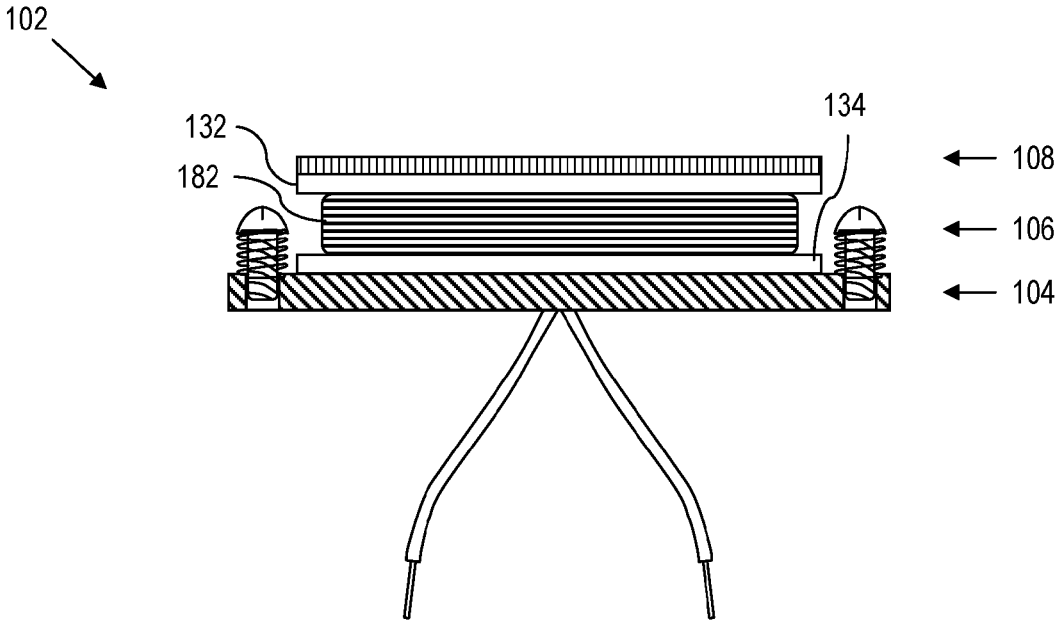
FIG. 6 is a side view of a pickup with a first example wire winding, according to aspects of the present disclosure.

Referring to FIG. 6, the pickup 102 is illustrated with a coil of wire 182 wrapped about the coil assembly 106. In the example of FIG. 6, the coil is wrapped between the primary flatwork member 132 and the secondary flatwork member 134 substantially consistently.

Figure 7:
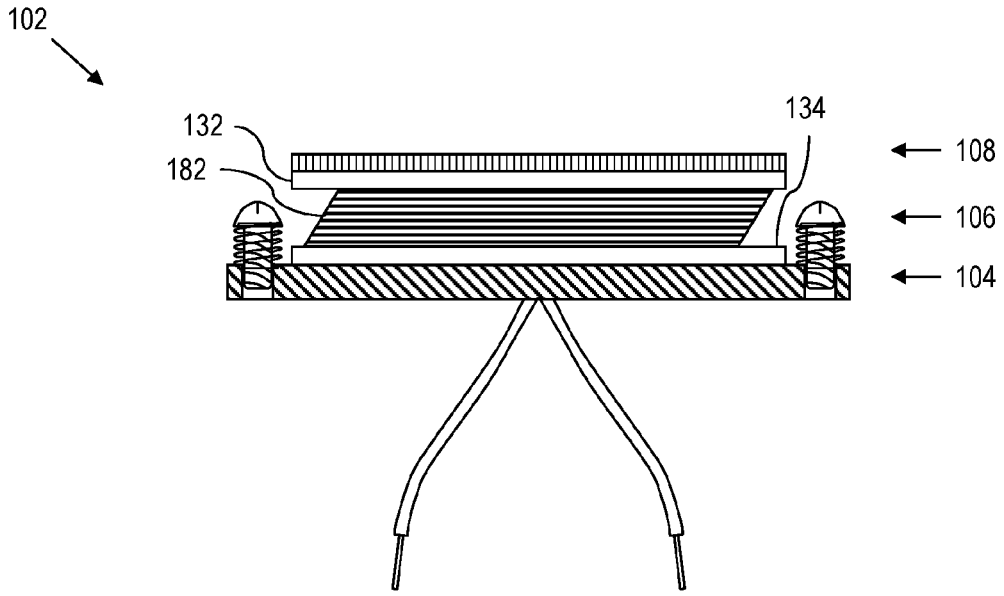
FIG. 7 is a side view of a pickup with a second example wire winding, according to aspects of the present disclosure.

Reference is now drawn to FIG. 7. FIG. 7 is analogous to FIG. 6, except that the coil of wire 182 is wrapped as a parallelogram between the primary flatwork member 132 and the secondary flatwork member 134. Note that this wrapping pattern will cause changes in sound depending upon the orientation of the coil assembly 106 by favoring either the bass strings or treble strings.

Figure 8:
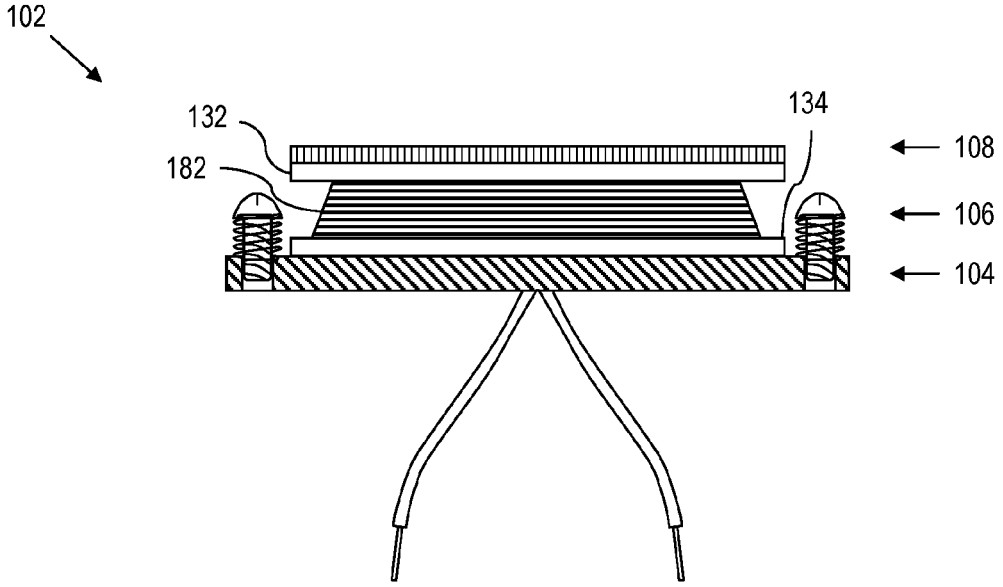
FIG. 8 is a side view of a pickup with a third example wire winding, according to aspects of the present disclosure.

Reference is now drawn to FIG. 8. FIG. 8 is analogous to FIG. 6, except that the coil of wire 182 is wrapped as a generally trapezoid shape between the primary flatwork member 132 and the secondary flatwork member 134. Note that this wrapping pattern will cause changes in sound depending upon the orientation of the coil assembly 106 by providing a relatively stronger output or weaker output depending upon the orientation of the coil assembly 106 when installed in a corresponding stringed musical instrument.

With reference to FIG. 6-8 generally, regardless of winding pattern, the coil of wire 182 can in practice be a single continuous coated/insulated wire. Alternatively, the coil of wire 182 may be constructed from the series connection of one or more wire types. The wire is typically fine, e.g., on the order of 42 gauge or 43 gauge. However, any practical wire thickness (or thicknesses) can be used, depending upon the desired electrical properties of the pickup 102. Moreover, the wire 182 can be constructed of any suitable material, e.g., copper, silver, gold, combinations thereof, etc. The number of turns of wire 182, wrapping pattern, height of the coil, width of the coil, etc., will depend upon the desired electrical characteristics of the pickup 102. However, typical pickups utilize several thousand turns of wire 182.

In practice, once the coil of wire 182 is properly wrapped and soldered to the coil assembly 106, a length of wire (e.g., the same wire used to build the coil of wire 182) can optionally be wrapped around the coil of wire 182 so as to cover the entire coil, thus serving as a protective element. The wrapping of wire may also be utilized as a design element or for other decorative purposes. The coil of wire 182 can be protected by other and/or alternative protective elements as well. Examples of other protective elements include string, tape, cloth, etc.

In certain example implementations, the coil assembly 106 is "potted", so as to provide a potted treatment about the coil of wire 182. For instance, the coil assembly 106 may be treated in a melted mixture of paraffin, wax, chemical polymers or combinations thereof. This helps prevent microphonics in the pickup by preventing the wire in the coil of wire 182 from vibrating. In an illustrative implementation, the pickup is treated but is not vacuum chambered. Alternatively, the coil assembly 106 may be vacuum chambered.

Figure 9:
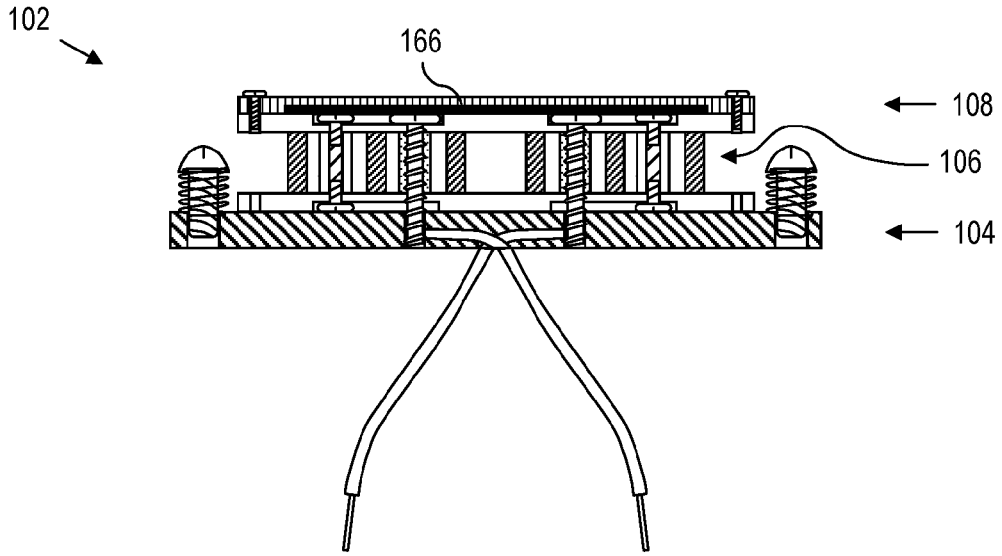
FIG. 9 is an example of a single coil pickup according to aspects of the present disclosure herein, with a magnet positioned over a coil component opposite a mounting component, according to aspects of the present disclosure.

Reference is now drawn to FIG. 9. FIG. 9 is an example implementation of the pickup 102. The view is similar to that of FIG. 2, except that the pickup is assembled together. Like FIG. 2, the coil 182 (FIGS. 6-8) is removed for clarity of discussion.

In the Example of FIG. 9, the well 162 in the cover plate 160 is used to secure one or more magnet(s) 166 that cooperate with the pole 136. This configuration makes it easiest to change the magnet configuration without modification to the coil assembly 106, e.g., by replacing the magnet(s) 166 with magnets 166 having different properties, or by replacing the cover plate 160 (with different magnets 166).

Figure 10:
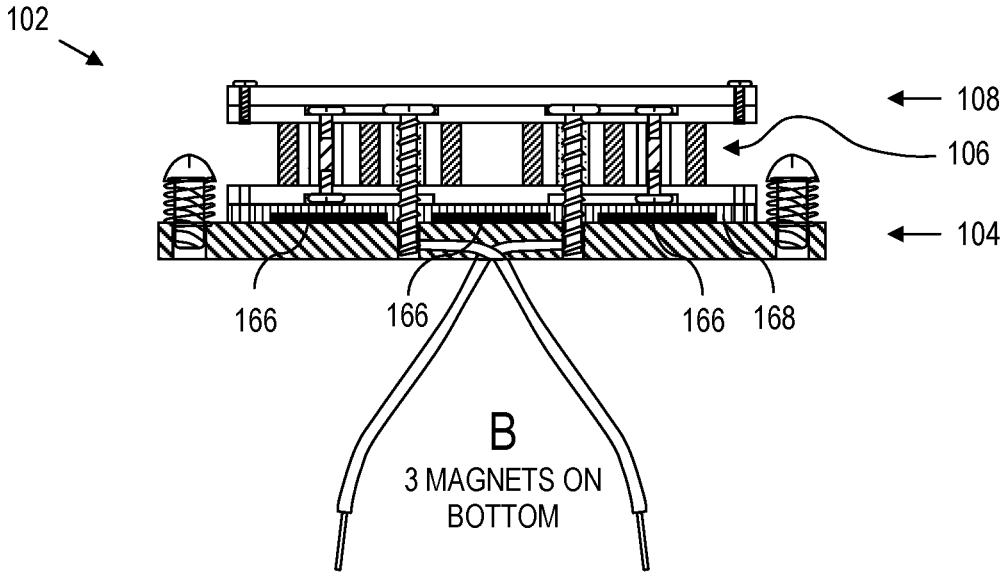
FIG. 10 is an example of a single coil pickup according to aspects of the present disclosure herein, with a magnet positioned between a coil component and a mounting component, according to aspects of the present disclosure.

Reference is now drawn to FIG. 10. FIG. 10 is largely analogous to that of FIG. 2 and FIG. 9 except that the cover plate 160 need not include magnets 166. Rather, the magnets 166 are moved to a position between the coil assembly 106 and the mounting assembly 104, e.g., by inserting the magnets 166 into wells of a corresponding magnet housing 168. This configuration makes it easiest to change the coil configuration without modification to the magnets 166, e.g., by replacing or reorienting the coil assembly 106.

Figure 11:
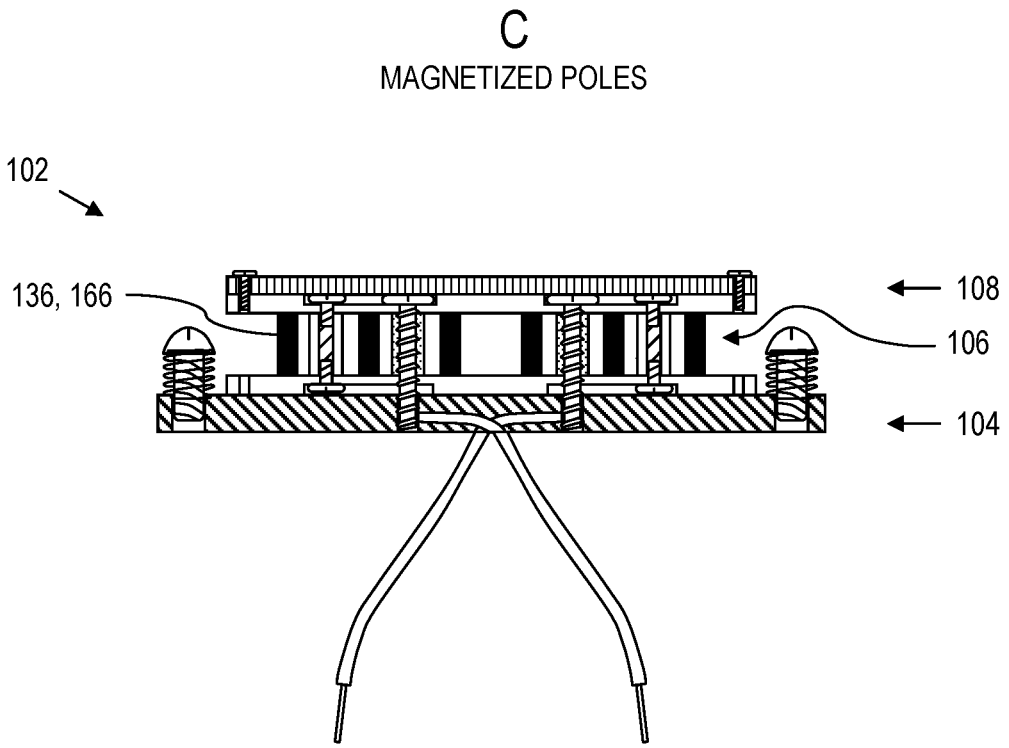
FIG. 11 is an example of a single coil pickup according to aspects of the present disclosure herein, with magnetized pole pieces, according to aspects of the present disclosure.

Reference is now drawn to FIG. 11. FIG. 11 is largely analogous to that of FIG. 2, FIG. 9, and FIG. 10 except that the pole 136 is magnetized, thus also functioning as the magnets 166. This configuration minimizes parts, but requires replacement of the coil assembly 106 if the user desires to change the magnet material. Note that magnets 166 can optionally be added as well, to the top, bottom or both.

Figure 12:
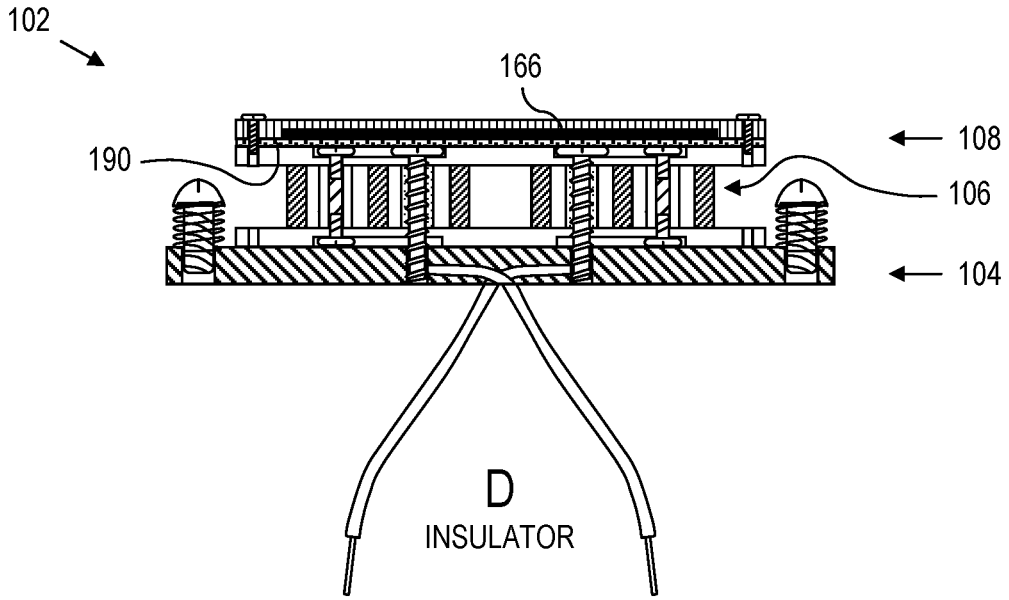
FIG. 12 is view of the pickup of FIG. 1 and FIG. 2 in an assembled state with an optional insulating layer between a magnet housing and a coil component, according to further aspects of the present disclosure.

Reference is now drawn to FIG. 12. FIG. 12 is the same as FIG. 9 except that a damping material 190 is added between the magnet 166 and the coil assembly 106. The material reduces and/or removes microphonics by damping any vibration that may occur between the magnet 166 and the pole 136.

Figure 13:
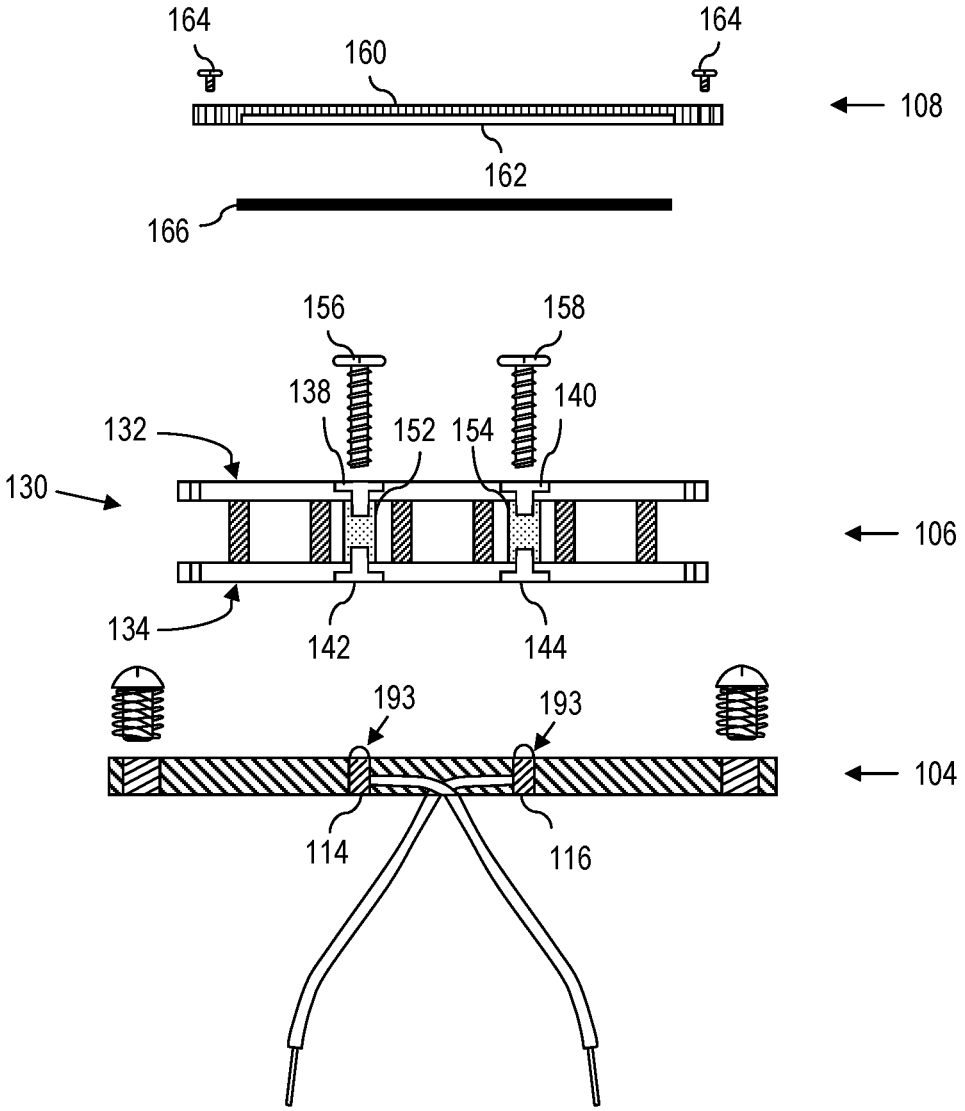
FIG. 13 is an exploded assembly view of a pickup according to further aspects of the present disclosure.

Referring to FIG. 13, in certain example implementations, it is possible to remove the need for the first conductive bridge 146 and the second conductive bridge 148. Here, the first guide component 152 and a second guide component 154 are conductive. As with the previous example, the first end of the coil wire (not shown for clarity) can attach, e.g., solder, to the first coil component contact 138. Alternatively, the first end of the coil wire can solder directly to the first conductive fastener 156. Likewise, as with the previous example, the second end of the coil wire (not shown for clarity) can attach, e.g., solder, to the second coil component contact 140. Alternatively, the second end of the coil wire can solder directly to the second conductive fastener 158.

In an example implementation, the first coil component contact 138, the second coil component contact 140, the third coil component contact 142, and the fourth coil component contact 144 can each include or otherwise be implemented by a conductive flanged member, e.g., ferrule, flanged bushing or other structure. The flanged structure provides a conductive contact surface for the first conductive fastener 156 and second conductive fastener 158 regardless of the orientation of the coil assembly 106.

The flanged conductive members 138, 140, 142, 144 can be seated into wells in the primary flatwork member 132 and the secondary flatwork member 134 analogous to that set out in greater detail herein. Otherwise, this embodiment can include any feature described more fully herein with regard to the remaining FIGURES.

Also, the first contact 114 and the second contact 116 can each include a conductive spring, ball, or other structure that biases against the coil assembly 106 to aide in proper electrical connection. For instance, in an example embodiment, a first optional spring 193 aides in a suitable electrical connection between the first conductive fastener 156 and the first contact 114 of the mounting assembly 104. Also, an optional spring 193 aides in a suitable electrical connection between the second conductive fastener 158 and the second contact 116 of the mounting assembly 104.

Figure 14:
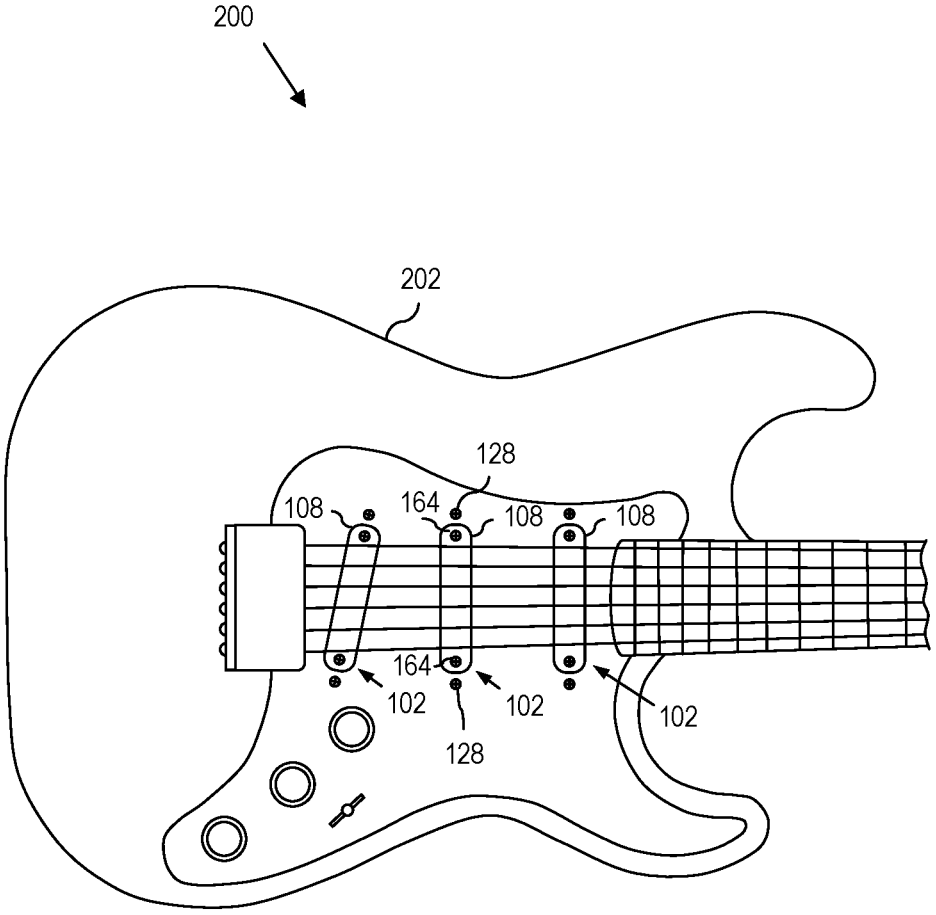
FIG. 14 is a top view of a stringed musical instrument having the three pickups installed therein, according to aspects of the present disclosure.

Referring to FIG. 14, a stringed musical instrument 200, e.g., an electric guitar is shown with three pickups 102 installed therein. In practice, the stringed musical instrument 200 can be any instrument type, e.g., guitar, bass, etc. Moreover, any number of pickups 102 in any configuration can be installed as the instrument supports. Only the guitar body 202 is shown for clarity of discussion. When installed, the cover assembly 108 is exposed through the pickguard as shown. As noted, the cover assembly 108 can be removed without taking the guitar apart. Indeed, it may be possible to remove the cover assembly 108 without even loosening the strings. If the magnets are seated in the cover assembly 108, then magnet changes can be made without disturbing the guitar, simply by swapping out the cover assembly 108.

Figure 15:
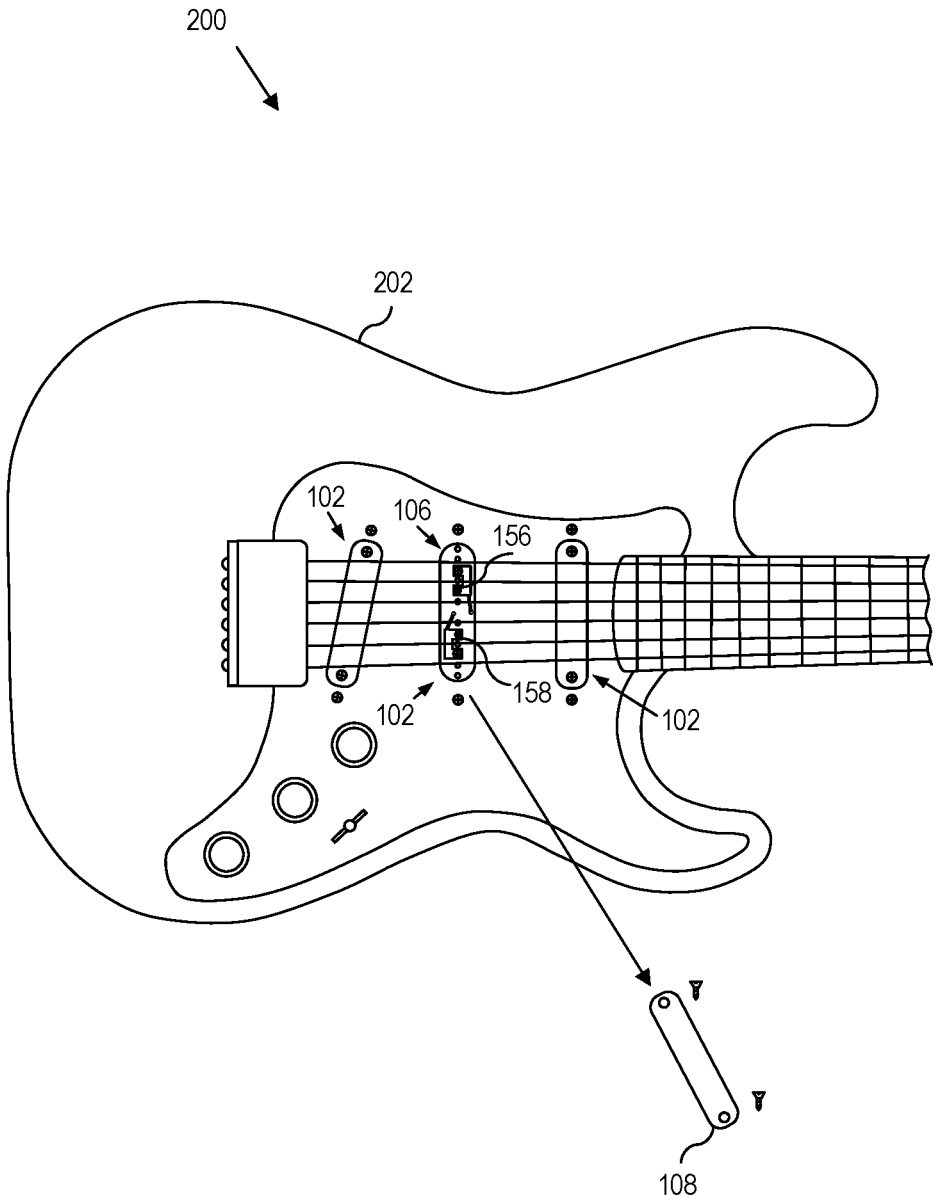
FIG. 15 is a view of the stringed musical instrument of FIG. 14, with the cover of the middle pickup removed, exposing the coil assembly, according to aspects of the present disclosure.

Referring to FIG. 15, the cover assembly 108 is removed, exposing the coil assembly 106. To make a change to the coil assembly 106, the first conductive fastener 156 and the second conductive fastener 158 are removed. Here, it may be necessary to loosen the strings on the stringed musical instrument 200. Upon removing the first conductive fastener 156 and the second conductive fastener 158, the coil assembly 106 can be removed and replaced, reoriented, etc., as described more fully herein.

Figure 16:
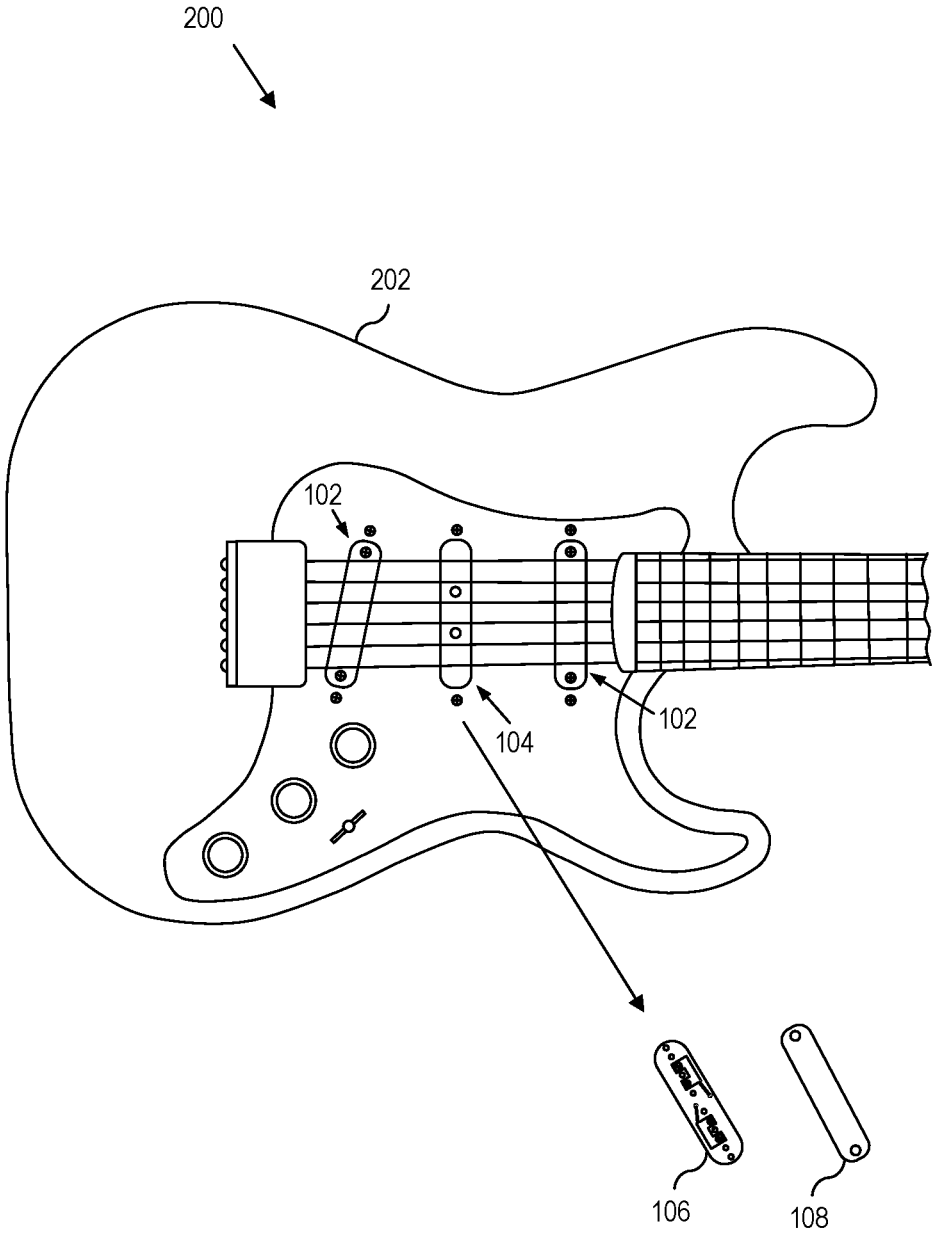
FIG. 16 is a view of the stringed musical instrument of FIG. 14, with the coil component of the middle pickup removed, exposing the mounting component, according to aspects of the present disclosure.

Referring to FIG. 16, with the coil assembly 106 removed, the mounting assembly 104 is exposed. The mounting assembly 104 can be hard wired to the electronics of the stringed musical instrument. As can be realized, pickup configuration can be readily changed, e.g., with the removal of two to four screws, without any disassembly to the guitar once the mounting assembly 104 is properly installed.

Figure 17:
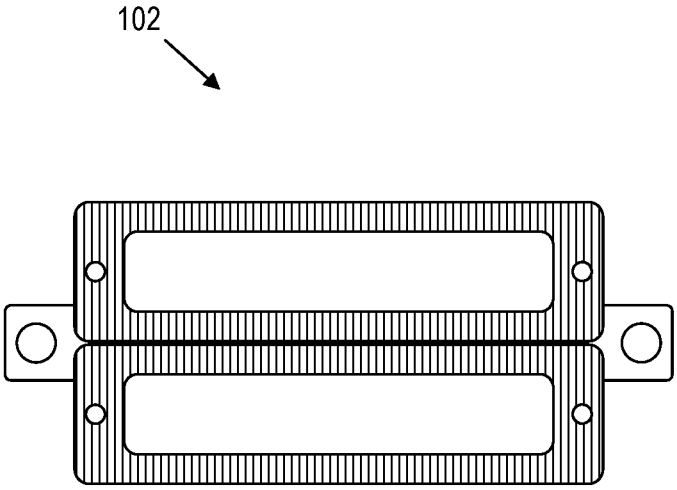
FIG. 17 is a humbucker configuration of a pickup using techniques described more fully herein.

Referring to FIG. 17, a pickup 102 is illustrated as a dual coil or humbucker configuration. The humbucker can be built using two single coil assemblies described more fully herein. Here, the properties of each single coil assembly can be the same or different. Here, wiring for each coil can be separate, or the coils can be pre-wired together.

Field Adjusting Control

Figure 18:
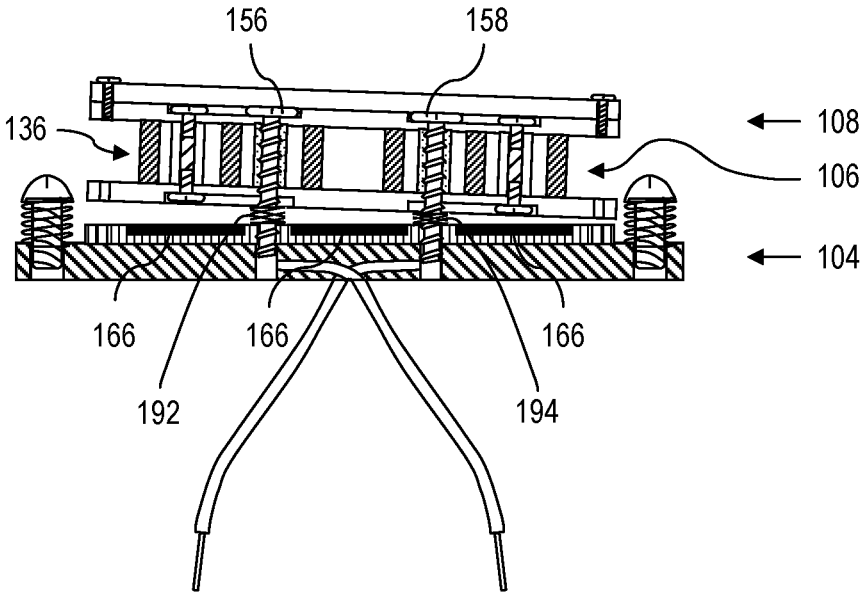
FIG. 18 is a side view of select components of a pickup showing the use of adjustable springs to vary the distance of the magnet from the pole according to aspects of the present disclosure.

Referring to FIG. 18, a pickup 102 is illustrated, which can include any configuration described more fully herein. The magnet 166 typically makes direct physical contact with the pole 136 (e.g., the blade or each slug, screw, etc.) or is spaced in a fixed relationship close thereto. However, such need not be the case. In this regard, adjustability of the magnet 166 relative to the pole 136 can be used to further alter the electrical/magnetic properties of the pickup.

For instance, according to an illustrative implementation, a field-adjusting control is provided, that is user adjustable. Adjustment of the field adjusting control adjusts the distance of the magnet 166 from the pole 136. In an example embodiment, the field-adjusting control comprises a spring that biases at least one magnet a user-adjustable distance from the pole.

For instance, as illustrated, this pickup 102 includes a first biasing spring 192, and an optional second biasing spring 194 that can be used to user adjustably alter the distance of the magnet 166 relative to the pole 136. More particularly, adjustment of the first conductive fastener 156 the second conductive fastener 158 selectively moves a first end of the magnet 166 relative to the pole 136 such that magnetic coupling remains. Likewise, adjustment of the second conductive fastener 158 selectively moves a second end of the magnet 166 relative to the pole 136 such that magnetic coupling remains. This adjustability can be used to change for instance, the response of the pickup to achieve greater impact on the treble-side strings or bass-side strings of a corresponding instrument, depending upon how the field adjusting control is operated.

As illustrated, the magnet 166 has been adjusted such that a distance from the magnet 166 to the pole 136 is non-uniform across the length of the pole 136. For instance, as illustrated, the magnet 166 is angled downward relative to the pole 136 such that the left side (as seen in the FIGURE) of the magnet 166 is further from the pole 136 than the right side (as seen in the FIGURE) of the magnet, thus affecting the impact of the strings across the pickup 102 differently.

Summary of Example Configuration

Referring to the FIGURES generally, in an example configuration, a first coil component contact 138 forms a first pad of the primary flatwork member 132, and a second coil component contact 140 forms a second pad of the primary flatwork member 132. Likewise, a third coil component contact 142 forms a first pad of the secondary flatwork member 134 and a fourth coil component contact 144 forms a second pad of the secondary flatwork member 134. A first conductive bridge 146 electrically connects the first pad of the primary flatwork member 132 to the first pad of the secondary flatwork member 134, and a second conductive bridge 148 electrically connects the second pad of the primary flatwork member 132 to the second pad of the secondary flatwork member 134. Here, the first contact 114 of the mounting component 110 comprises a first conductive insert having an internal threaded surface, the first conductive insert electrically connected to a first lead wire 118. Likewise, a second contact 116 of the mounting component 110 comprises a second conductive insert having an internal threaded surface, the second conductive insert electrically connected to a second lead wire 120.

A first threaded fastener, e.g., a first conductive fastener 156 mechanically couples the coil component 130 to the mounting component 110, the first threaded fastener further electrically couples a first coil end of a coil of wire to the first conductive insert of the mounting component 110 via at least one of the first pad on the primary flatwork member 132 and the first pad on the secondary flatwork member 134. Analogously, a second threaded fastener, e.g., a second conductive fastener 158 mechanically couples the coil component 130 to the mounting component 110. The second threaded fastener further electrically couples a second coil end of the coil of wire to the second conductive insert of the mounting component 110 via at least one of the second pad on the primary flatwork member 132 and the second pad on the secondary flatwork member 134.

The pickup 102 also includes at least one magnetics component comprising a magnet housing, e.g., implemented in the cover assembly 108 or otherwise. At least one magnet 166 is supported by the magnet housing, such that when the pickup 102 is assembled, the mounting component 110, the coil component 130, and the magnetics component are assembled together such that at least one magnet 166 of the magnetics component is in magnetic cooperation with the pole 136.

Miscellaneous

Referring to the FIGURES generally, a pickup 102 is provided that allows the coil, coil orientation, magnetic properties, or combinations thereof to be changed without de-soldering the wiring of the pickup to the other electronics of the instrument. Here, the mounting assembly 104, the coil assembly 106 and the cover assembly 108 are independent from each other, allowing instances of the mounting assembly 104, the coil assembly 106 and the cover assembly 108 to be freely mixed and matched. The coil assembly 106 and the cover assembly 108 attach and detach from the mounting assembly 104 independently of any electrical connections made by the first lead wire 118 and the second lead wire 120. This allows the mounting assembly 104, the coil assembly 106 and the cover assembly 108 to be separately manufactured. Moreover, the above-structure allows the coil assembly 106 and the cover assembly 108 to be coupled to the mounting assembly 104 any time before, during, or after the pickup 102 has been installed in an instrument.

As noted in greater detail herein, the pickup can be configured with at least one of a magnet positioned over the coil component opposite the mounting component, a magnet positioned between coil component and the mounting component, and a magnet integrated with the pole.

Although illustrated as using fasteners, e.g., bolts or screws, the mounting assembly 104, the coil assembly 106 and the cover assembly 108 can user attach and detach using other approaches, e.g., bands, clips, snaps, hook and loop fastener, magnets, etc. Moreover, other structures may be included, such as a shim, a plate, a spacer, a well cover, etc.

The magnet 166 cooperates with the pole 136 to create a magnetic field about the pickup 102. In this regard, when assembled, the pole(s) 136 is/are in magnetic cooperation with the magnet(s) 166. When the pickup 102 is installed in a corresponding electrical stringed musical instrument, the pole 136 sits beneath the strings. The pole 136, in cooperation with the magnet 166 shapes a magnetic field that surrounds the pickup 102. The strings are composed of a magnetizable structure, e.g., metal such as steel, a magnetizable alloy or other structure that can interact with the magnetic field of the pickup 102. When the strings vibrate, the vibration of the string causes a corresponding change in the magnetic field about the pickup 102. This change in the magnetic field induces a corresponding electrical current in the coil of wire 182. That electrical current is output through a corresponding instrument and optional instrument electronics to an amplifier.

Traditionally, pickups provide either no adjustability, or very minor adjustability (e.g., where the pole is implemented with threaded adjustment means). However, for drastic changes, one is left with swapping out one pickup for another. Moreover, most pickups have exposed wires and are delicate, thus posing the risk of damage to the pickup. The prospect of damaging a pickup makes swapping pickups more difficult and time consuming. However, by utilizing the changeable magnet assembly and/or coil assembly described herein, both a manufacturer and the consumer have the benefit of being able to drastically alter the tonal qualities of a pickup, and have the ability to customize the pickup's performance. Additionally, the strain relief and protective wrapping about the coil of wire makes the pickup of the present disclosure more durable than traditional pickups, thus easing experimentation with magnet configurations, coil configurations, and coil orientations, to find an optimal musical result from the pickup installed in a corresponding stringed musical instrument. Changes can affect strength of the output, frequency response of the output, phase, harmonics, or a combination thereof. Changes in the coil assembly can be implemented by modification to the wiring direction, wire gauge, number of turns of wire, winding pattern, etc.

An additional benefit is that there are no vulnerable exposed coil wires, thus improving reliability and reducing customer returns. Moreover, the cover assembly 108, the coil assembly 106, and the mounting assembly 104 can be sold separately, mixed and matched, etc., to have numerous customization options.

Also, by utilizing a cover assembly 108, the appearance of the pickup can be changed by changing out the cover assembly 108. Thus, for instance, further customization can be realized by using wood, plastic, stone, or other non-conductive material to alter the aesthetics of the pickup.

Although described herein in the context of a single coil pickup, it is to be readily understood that the above-described techniques can be applied to humbucker pickups and other desired configurations that use one or more coils, sets of magnets, poles or combinations thereof.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure.

Having thus described the disclosure of the present application in detail and by reference to embodiments thereof, it will be apparent that modifications and variations are possible without departing from the scope of the disclosure defined in the appended claims.

What is claimed is:

1. A pickup for an electrical, stringed musical instrument, comprising:

a mounting assembly comprising:

a mounting component having a first contact and a second contact, the first contact and the second contact for connection to electronics of a musical instrument to which the pickup is installed; and a coil assembly comprising:

a primary flatwork member having a first pad and a second pad;

a secondary flatwork member having a first pad and a second pad;

a pole that mounts between the primary flatwork member and the secondary flatwork member;

a coil of wire wrapped around the pole, the coil of wire having:

a first coil end electrically connected to at least one of the first pad of the primary flatwork member and the first pad of the secondary flatwork member; and a second coil end electrically connected to at least one of the second pad of the primary flatwork member and the second pad of the secondary flatwork member;

a first conductive bridge that electrically connects the first pad of the primary flatwork member to the first pad of the secondary flatwork member; and a second conductive bridge that electrically connects the second pad of the primary flatwork member to the second pad of the secondary flatwork member;

wherein when the pickup is assembled:

the coil component is user oriented with a select one of the primary flatwork member and the secondary flatwork member towards the mounting plate;

the first coil end electrically couples to a select one of the first contact and the second contact of the mounting member regardless of the orientation of the coil component; and the second coil end electrically couples to the remaining one of the first contact and the second contact of the mounting member regardless of the orientation of the coil component.

2. The pickup of claim 1 further comprising:

at least one of:

a magnet positioned over the coil component opposite the mounting component;

a magnet positioned between coil component and the mounting component; and a magnet integrated with the pole.

3. The pickup of claim 1, wherein:

the first contact of the mounting component comprises a first conductive insert having an internal threaded surface, the first conductive insert electrically connected to a first lead wire; and the second contact of the mounting component comprises a second conductive insert having an internal threaded surface, the second conductive insert electrically connected to a second lead wire;

the pickup further comprising:

a first threaded fastener that mechanically couples the coil assembly to the mounting assembly, the first threaded fastener further electrically coupling the first coil end of the coil of wire to the first conductive insert of the mounting component via at least one of the first pad on the primary flatwork member and the first pad on the secondary flatwork member; and a second threaded fastener that mechanically couples the coil assembly to the mounting assembly, the second threaded fastener further electrically coupling the second coil end of the coil of wire to the second conductive insert of the mounting component via at least one of the second pad on the primary flatwork member and the second pad on the secondary flatwork member.

4. The pickup of claim 3 further comprising:

a first non-conductive guide component between the primary flatwork member and the secondary flatwork member that aligns with the first contact of the mounting component and guides the first threaded fastener through the coil assembly; and a second non-conductive guide component between the primary flatwork member and the secondary flatwork member that aligns with the second contact of the mounting component and guides the second threaded fastener through the coil assembly.

5. The pickup of claim 1 further comprising:

a spring that biases at least one magnet a user-adjustable distance from the pole.

6. The pickup of claim 1, wherein:

the coil of wire is wrapped so as to define a generally parallelogram shape relative to the pole.

7. A pickup for a stringed musical instrument, comprising:

a mounting component comprising:

a mounting plate having a first contact and a second contact, the first contact and the second contact for connection to electronics of a musical instrument to which the pickup is installed;

a coil component comprising:

a primary flatwork member having a first contact and a second contact;

a secondary flatwork member having a third contact and a fourth contact;

a pole piece that mounts between the primary flatwork member and the secondary flatwork member; and a coil of wire wrapped around the pole piece, the coil of wire having:

a first coil end that electrically connects to the first contact on the primary flatwork member and the third contact on the secondary contact member at least when the coil component is attached to the mounting plate; and a second coil end that electrically connects to the second contact on the primary flatwork member and the fourth contact on the secondary contact member at least when the coil component is attached to the mounting plate; and a magnetics component comprising:

a magnet housing; and a magnet supported by the magnet housing;

wherein:

the mounting component, the coil component, and the magnetics component are assembled together such that the magnet of the magnetics component is in magnetic cooperation with the pole piece; and when assembled:

a select one of the primary flatwork and the secondary flatwork is oriented towards the mounting plate;

the first coil end electrically couples to a select one of the first contact and the second contact of the mounting member; and the second coil end electrically couples to the remaining one of the first contact and the second contact of the mounting member.

8. The pickup of claim 7 further comprising:

a spring that biases at least one magnet a user-adjustable distance from the pole.

9. The pickup of claim 7, wherein:

the coil of wire is wrapped so as to define a generally trapezoid shape relative to the pole.

10. The pickup of claim 7, wherein:

the coil of wire is wrapped so as to define a generally parallelogram shape relative to the pole.

11. The pickup of claim 7, wherein:

the magnet housing is positioned at a select position of:

over the coil component opposite the mounting component; and between coil component and the mounting component.

12. A pickup for a stringed musical instrument, comprising:

a mounting component comprising:

a mounting plate having a first contact and a second contact, the first contact and the second contact for connection to electronics of a musical instrument to which the pickup is installed;

a coil component comprising:

a primary flatwork member having a first contact and a second contact;

a secondary flatwork member having a first contact and a second contact;

a pole piece that mounts between the primary flatwork member and the secondary flatwork member; and a coil of wire wrapped around the pole piece, the coil of wire having:

a first coil end that electrically connects to the first contact of the primary flatwork member and the first contact of the secondary contact member at least when the coil component is attached to the mounting plate; and a second coil end that electrically connects to the second contact of the primary flatwork member and the second contact of the secondary contact member at least when the coil component is attached to the mounting plate; and a magnet in magnetic cooperation with the pole piece of the coil component;

wherein:

when the pickup is assembled, a select one of the primary flatwork and the secondary flatwork is oriented towards the mounting plate;

the first coil end electrically couples to a select one of the first contact and the second contact of the mounting member; and the second coil end electrically couples to the remaining one of the first contact and the second contact of the mounting member.

13. The pickup of claim 12 further comprising:

a spring that biases at least one magnet a user-adjustable distance from the pole.

14. The pickup of claim 12, wherein:

the coil of wire is wrapped so as to define a select one of a generally trapezoid shape and a generally parallelogram shape relative to the pole.

15. The pickup of claim 12, wherein the magnet is implemented as at least one of:

a magnet positioned over the coil component opposite the mounting component;

a magnet positioned between coil component and the mounting component;

a magnet integrated with the pole; and a combination thereof.

16. The pickup of claim 12, wherein:

the first contact forms a first pad of the primary flatwork member; and the second contact forms a second pad of the primary flatwork member;

further comprising:

a third contact that forms a first pad of the secondary flatwork member;

a fourth contact that forms a second pad of the secondary flatwork member;

a first conductive bridge that electrically connects the first pad of the primary flatwork member to the first pad of the secondary flatwork member; and a second conductive bridge that electrically connects the second pad of the primary flatwork member to the second pad of the secondary flatwork member.

17. The pickup of claim 16, wherein:

the first contact of the mounting component comprises a first conductive insert having an internal threaded surface, the first conductive insert electrically connected to a first lead wire; and the second contact of the mounting component comprises a second conductive insert having an internal threaded surface, the second conductive insert electrically connected to a second lead wire;

further comprising:

a first threaded fastener that mechanically couples the coil assembly to the mounting assembly, the first threaded fastener further electrically coupling the first coil end of the coil of wire to the first conductive insert of the mounting component via at least one of the first pad on the primary flatwork member and the first pad on the secondary flatwork member; and a second threaded fastener that mechanically couples the coil assembly to the mounting assembly, the second threaded fastener further electrically coupling the second coil end of the coil of wire to the second conductive insert of the mounting component via at least one of the second pad on the primary flatwork member and the second pad on the secondary flatwork member.

18. A pickup for an electrical, stringed musical instrument, comprising:

a mounting assembly comprising:

a mounting component having a first contact and a second contact, the first contact and the second contact for connection to electronics of a musical instrument to which the pickup is installed;

a coil assembly comprising:

a primary flatwork member;

a secondary flatwork member;

a pole that mounts between the primary flatwork member and the secondary flatwork member; and a coil of wire wrapped around the pole, the coil of wire having:

a first coil end electrically connected to a first coil component contact; and a second coil end electrically connected to a second coil component contact; and a magnetics component comprising:

a magnet housing; and at least one magnet supported by the magnet housing;

wherein when the pickup is assembled:

the coil component is user oriented with a select one of the primary flatwork member and the secondary flatwork member towards the mounting plate;

the first coil end electrically couples to a select one of the first contact and the second contact of the mounting member regardless of the orientation of the coil component;

the second coil end electrically couples to the remaining one of the first contact and the second contact of the mounting member regardless of the orientation of the coil component; and the mounting assembly, the coil assembly, and the magnetics component are assembled together such that the at least one magnet of the magnetics component is in magnetic cooperation with the pole.

19. A pickup for an electrical, stringed musical instrument, comprising:

a mounting assembly comprising:

a mounting component having a first contact and a second contact, the first contact and the second contact for connection to electronics of a musical instrument to which the pickup is installed; and a coil assembly comprising:

a primary flatwork member;

a secondary flatwork member;

a pole that mounts between the primary flatwork member and the secondary flatwork member;

a coil of wire wrapped around the pole so as to define a generally trapezoid shape relative to the pole, the coil of wire having:

wherein when the pickup is assembled:

the coil component is user oriented with a select one of the primary flatwork member and the secondary flatwork member towards the mounting plate;

the first coil end electrically couples to a select one of the first contact and the second contact of the mounting member regardless of the orientation of the coil component; and the second coil end electrically couples to the remaining one of the first contact and the second contact of the mounting member regardless of the orientation of the coil component.

20. The pickup of claim 18, wherein:

the primary flatwork member has a first contact and a second contact;

the secondary flatwork member having a first contact and a second contact;

a first conductive bridge electrically couples the first contact of the primary flatwork member to the first contact of the secondary flatwork member;

a second conductive bridge electrically couples the second contact of the primary flatwork member to the second contact of the secondary flatwork member;

a first coil end of the coil is electrically coupled to the first contact of the primary flatwork member and the first contact of the secondary flatwork member; and a second coil end of the coil is electrically coupled to the second contact of the primary flatwork member and the second contact of the secondary flatwork member.

* * * * *